United States Patent [19]

Haftmann

[11] 4,407,593

[45] Oct. 4, 1983

[54] ARRANGEMENT FOR MONITORING THE OPERATION OF THE INK RIBBON OF AN INK-RIBBON MAGAZINE

[75] Inventor: Johannes Haftmann, Paderborn, Fed. Rep. of Germany

[73] Assignee: Nixdorf Computer AG, Fed. Rep. of Germany

[21] Appl. No.: 356,705

[22] Filed: Mar. 10, 1982

[30] Foreign Application Priority Data

Mar. 27, 1981 [DE] Fed. Rep. of Germany ... 8108981[U]

[51] Int. Cl.[3] ..... B41J 35/28

[52] U.S. Cl. ..... 400/208; 400/249

[58] Field of Search ..... 400/249, 207, 208, 208.1, 400/194, 195, 196, 196.1, 708, 708.1, 247; 242/186, 188; 226/11, 45

[56] References Cited

U.S. PATENT DOCUMENTS

| | | | |
|---|---|---|---|
| 549,421 | 11/1895 | Ashby | 400/708.1 |
| 3,666,203 | 5/1972 | Sato et al. | 242/188 |
| 3,819,029 | 6/1974 | Simmons, Jr. | 400/708.1 X |

FOREIGN PATENT DOCUMENTS

| | | | |
|---|---|---|---|
| 2512259 | 9/1976 | Fed. Rep. of Germany | 400/249 |
| 56-8286 | 1/1981 | Japan | 400/249 |
| 1499152 | 1/1978 | United Kingdom | 400/196 |

*Primary Examiner*—Edgar S. Burr
*Assistant Examiner*—Charles A. Pearson
*Attorney, Agent, or Firm*—Krass, Young & Schivley

[57] ABSTRACT

An arrangement for monitoring the operation of the ink ribbon (2) of an ink-ribbon magazine (1) for electromechanical print units or print mechanisms comprises contacts (12,6) on the ink-ribbon magazine (1) on either side of the ink ribbon's path (4) and intended to lie against the ink ribbon (2), and opposite contacts (7,8) on the print unit which, when the ink ribbon magazine (1) is inserted, are in contact with the contacts (21,6) of the later and are connected electrically to a function or malfunction indication (10). When holes or tears occur on the ink ribbon (2), the contacts (12,6) on the ink-ribbon magazine (1) come in contact with one another and thereby set off a signal which can be used to switch off the print unit and/or for a malfunction indication.

6 Claims, 4 Drawing Figures

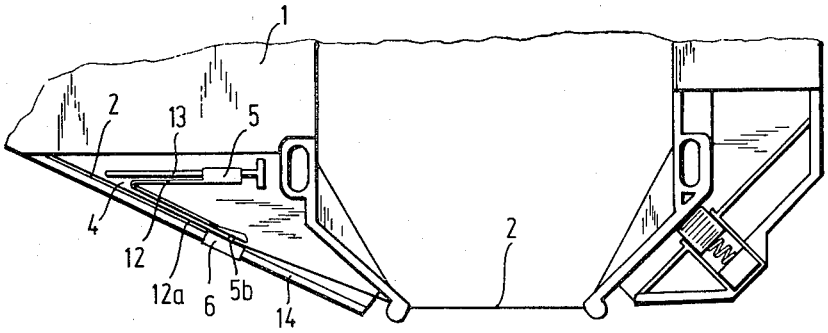
FIG. 2
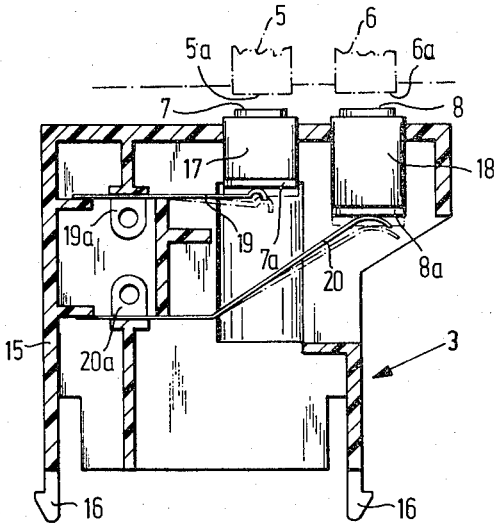
FIG. 3
FIG. 4
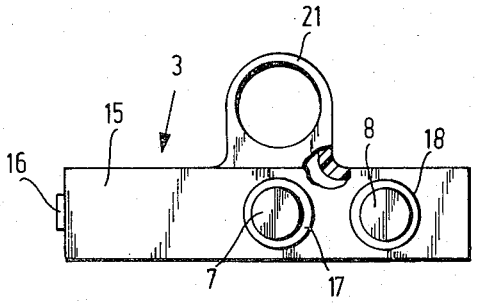

ARRANGEMENT FOR MONITORING THE OPERATION OF THE INK RIBBON OF AN INK-RIBBON MAGAZINE

DESCRIPTION

1. Technical Field

The invention relates to an arrangement for monitoring the operation of the ink ribbon of an ink-ribbon magazine for electromechanical print units and print mechanisms.

2. Background Art

In computer-controlled print units such as, for example, high-speed printers or the so-called automatic text mechanisms, in which the printing operation is not monitored continuously by operating personnel, the problem exists of detecting the wear on the ink ribbon in good time before the complete destruction of the ink ribbon. In particular, ink-ribbon magazines provided with the so-called reimpregnation devices have such a large ink reservoir that the fabric of the ink ribbon is frequently destroyed before the ink reservoir is exhausted. With the use of needle print units in particular, prolonged wear leads to small holes in the ink ribbon which can cause tearing of the ribbon if the ink ribbon is not replaced in good time. However, a tear in the ribbon can lead to considerable subsequent damage if the resulting ink ribbon end gets into the moving parts of the print unit.

DISCLOSURE OF INVENTION

The invention is based on the problem of supplying an arrangement of the type mentioned at the start which with little technical complexity is simple and economical to manufacture and reliable in operation, which can be attached to later print units as well as to existing ones.

The problem is solved according to the invention by arranging contacts, intended to rest against the ink ribbon, on the ink-ribbon magazine on either side of the ink ribbon's path and by having opposite contacts provided on the print unit which, when the ink-ribbon magazine is inserted, cooperate with its contacts in a working connection and are electrically connected with a print unit control and/or function or malfunction indicator.

If for example holes or tears occur in the ink ribbon due to prolonged wear, then the contacts opposite one another on the ink-ribbon magazine come in contact with one another and close a circuit, whereby either the print unit for example is brought to a standstill or an acoustical and/or optical signal is produced which indicates to the operating personnel that the ink ribbon must be replaced.

The contacts on the ink-ribbon magazine do not require much space and can therefore be attached to the ink-ribbon magazines without difficulty. The same holds true for the opposite contacts on the print unit.

Preferably the contacts are arranged spaced apart next to the segment of the ink ribbon's path forming the print region of the ink ribbon and each show a contact surface facing the cassette side and intended to lie against the respective opposite contact. Thereby in a simple way the making of a contact between the opposite contacts on the print unit and the contacts on the ink-ribbon magazine is assured when the magazine is inserted.

A first contact on the ink-ribbon magazine can for example be formed by an angularly bent leaf spring which is fastened by its one end region, carrying the contact surface, of its one spring leg to a web of the magazine case, the other spring leg of which forms a segment of an ink-ribbon guide, and with its end opposite the other contact, lies against the ink ribbon. This free spring leg can thus equalize differing stresses in the ink ribbon and always ensure that the ink ribbon runs through narrowly between the two opposite contacts. In this way at the same time the ink ribbon is tightened.

In order to ensure that the arrangement, according to the invention, responds even when there are small holes in the ink ribbon and thus makes possible a timely replacement of the ink ribbon, the contact surface of the first contact lying against the ink ribbon is at least approximately point-shaped.

The second contact may be formed by a simple contact strip which is bent around an outer web of the magazine case delimiting the ink ribbon's path.

In order to ensure a reliable contacting between the contacts on the ink-ribbon magazine and the opposite contacts on the print unit, the opposite contacts are preferably mounted in a contact carrier in such a way as to be movable in the direction of the contacts on the ink-ribbon magazine. For example, the opposite contacts are formed by contact studs or rivets which are guided movably on the contact carrier and are prestressed in the direction of the contact position by contact springs. The contact springs in turn serve as a terminal for electrical lines which connect the opposite contact with the print unit control or the malfunction indicator.

The contact carrier preferably consists of a one-piece frame-like plastic part which includes hook-shaped extensions intended for catching by snapping into recesses in the print unit. By means of these extensions, the contact carrier is releasably attached to the print unit, so that on the one hand it is easy to mount and on the other hand it can be removed again at any time.

The alignment of the contact carrier in its desired position can be facilitated still further by having the contact carrier include a centering bushing, for example, which can be slipped onto a centering pin on the print unit.

Further features and advantages of the invention are seen from the following description, which combined with the annexed drawings will explain the invention on the basis of an embodiment example.

BRIEF DESCRIPTION OF THE DRAWINGS

FIG. 2 shows a top plan view of the segment of the ink-ribbon magazine containing the print region of the ink ribbon;

FIG. 3 shows a section through a contact device including the opposite contact and the contact carrier; and FIG. 4 shows a top plan view of the contact device represented in FIG. 3.

BEST MODE FOR CARRYING OUT THE INVENTION

Figure 1:
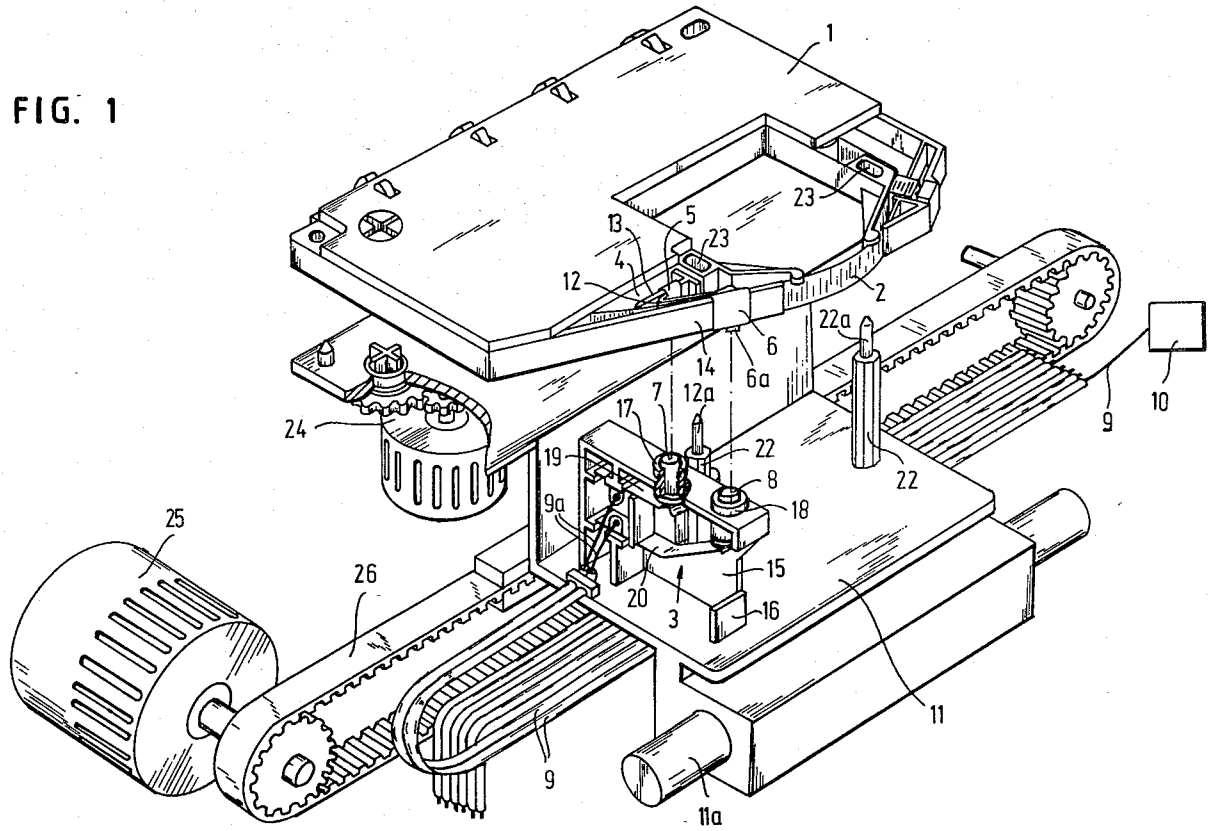
FIG. 1 shows a partly diagrammatic perspective view of a printer carriage of a print unit and an ink-ribbon magazine provided with contacts, in a noncontacting position.

In FIG. 1 as seen, a print unit known in itself with a printer carriage 11 which is mounted movably on a slide bar 11*a* and is capable of being moved to and fro, in a manner known in itself, by a timing belt 26 which in turn is driven by a motor 25.

Above the printer carriage 11 is seen an ink-ribbon magazine 1 with an ink ribbon 2. The ink-ribbon magazine 1 can be slipped onto the print unit, where centering pins 22 arranged on the printer carriage 11 engage with their respective centering points 22*a* in a corresponding centering opening or slot 23 of the magazine case. In this position of the ink-ribbon magazine, the ink ribbon can be conducted past the printer head, not represented, of the print unit by the use of a magazine drive 24 which is known in itself and is not described further.

On the ink-ribbon magazine 1, on either side of an ink-ribbon guide 4 and laterally next to the print region of the ink ribbon, are arranged two contacts 12 and 6 which sense the state of the ink ribbon 2 and thus enable one to test whether the ink ribbon 2 is still usable or whether it already shows holes and tears (see FIG. 2). The first contact consists of a leaf spring 12 bent at an acute angle which is fastened by its end segment 5 to a web 13 of the magazine case. The other leg 12*a* of the contact 12 runs substantially parallel to the ink ribbon 2 and forms part of the ink-ribbon guide. It carries on its free end an approximately point-shaped elevation 5*b* by which the contact 12 lies against the ink ribbon 2.

The second contact 6 is formed by a contact strip which is bent around a web 14, forming the outer boundary of the ribbon guide 4, of the ink-ribbon magazine 1. The two contact elements 12 and 6 are arranged in such a way that the ink ribbon 2 runs through between the contact 6 and the elevation 5*b* of the contact element 12. Thereby, the spring leg 12*a* of the contact 12 by its elevation 5*b* presses the ink ribbon 2 against the contact elevation 6, so that the ink ribbon 2 is stretched flat before it goes out into the print region. The contact 12 thus performs a double function as contact element and ribbon tension element.

It is seen that when holes or tears occur in the ink ribbon 2, the elevation 5*b* comes in direct contact with the contact element 6 in such a way that a contacting between the two contacts takes place.

The contacts 12 and 6 on the ink-ribbon magazine 1 are connected with the control equipment for the print unit or a function and malfunction indicator 10 (FIG. 1) by way of a contact device 3 which will now be described in detail on the basis of FIGS. 3 and 4, arranged on the printer carriage 11.

The contact device 3 comprises a contact carrier 15 as well as opposite contacts 7 and 8. The contact carrier 15 consists of a frame-like, one-piece plastic part which on its lower end shows at least two hook-shaped extensions 16 which are insertable for insertion into recesses, not represented, (slots or the like) in the printer carriage 11 and catch with their hook catches in such a way that the contact carrier is releasably attached to the printer carrier 11 by this snapping fastening.

On its upper side, the contact carrier 15 shows bushings 17 and 18 into which the pin-shaped or rivet-shaped contacts 7 or 8 are guided in axial mobility and whereby they are secured by a lower collar 7*a* or 8*a* against slipping out upwards on the bushings 17 and 18. The bushings 17 and 18 protrude slightly above the upper edge of the contact holder 15.

The two opposite contacts 7 and 8 each have assigned to them a contact spring 19 or 20 secured in the contact carrier 15 which spring acts by one of its ends on the lower end surface of the respective opposite contact 7 or 8. The contact springs 19 and 20 press the opposite contacts 7 or 8 against contact surfaces 5*a* or 6*a* of the contacts 12 or 6 on the ink-ribbon magazine 1 when the later is inserted into its operating position on the printer carriage 11. In FIG. 3, the contact 6 and the end 5 of the contact 12 are denoted by dot-dash lines. The contact springs 19 and 20 thus ensure a reliable contacting between the contacts 12 and 7 on the one hand as well as between 6 and 8 on the other hand.

The contact springs 19 and 20 each show near their other ends an eyelet 19*a* or 20*a* which serves for the connection between an electric line 9 by way of a connecting lead 9*a*. The electric line 9 connect the contact springs 19 and 20 with the control electronics, not represented, for the print unit and/or the function and malfunction indications 10.

It is seen that the opposite contacts 7 and 8 form the ends of an open circuit which can be closed by the contacts 12 and 6 when these make contact through the ink ribbon 2. As long as the ink ribbon 2 is undamaged, the contact is broken between the contacts 12 and 6. The function and malfunction indication 10 in this case either gives no indication at all or an indication that the ink ribbon is still in order.

If, however, holes or tears occur on the ink ribbon 2 which cause contact to be made between the contacts 12 and 6, then the previously open circuit becomes closed by way of the open contacts 12 and 6. The signal then occurring in the circuit can be used in the control for the print unit for bringing the print unit to an immediate standstill and/or producing an acoustical and/or optical signal in the function and malfunction indication 10 which indicates to the operating personnel that the print out, if necessary, has been brought to a standstill and the ink ribbon 1 must be replaced.

It is seen that both the contacts 12 and 6 on the ink-ribbon magazine and the contact device on the printer carriage 11 can also be incorporated later. For the later, however, it may be mentioned that not only the extensions 16 but also an eyelet 21 arranged on a lengthwise side of the frame-like contact carrier 15 permit a centering and alignment of the contact carrier with respect to the ink-ribbon magazine 1. The eyelet 21 formed on the contact carrier 15 then fits over one of the centering pins 22 of the printer carriage, whereby the contact carrier 15 becomes aligned accurately and is retained in its position.

I claim:

1. A devise for monitoring the physical condition of an ink ribbon (2) in an ink ribbon cassette (1) having an ink ribbon path and which is operatively but removably mounted on a printer unit (11), said device comprising:

first and second electrical contact means (12, 6) mounted on the cassette adjacent the ink ribbon path so as to contact opposite faces of the ribbon and be normally separated from one another by the ribbon, one (12) of said first and second contact means being resiliently biased toward the other (6) to provide a tensioning influence on the ribbon, each of said first and second contact means having an edge (5*a*, 6*a*) extending beyond the corresponding edge of said ribbon;

mounting means (15) on said printer unit adjacent said cassette when operatively mounted;

third and fourth contact means (7, 8) disposed on said mounting means in spaced relation for contacting the extending edges of the first and second contact means respectively when the cassette is operatively mounted;

means (19, 20) resiliently biasing said third and fourth contact means toward the extending edges of the first and second contact means; and indicator means (10) carried by the printer unit and electrically connected to the first and second contact means through the third and fourth contact means and the bias means to generate a signal whenever the physical condition of the ribbon allows the first and second contact means to touch one another.

2. A device as set forth in claim 1 wherein said first contact means (12) comprises a leaf spring bent at an acute angle and having opposite spaced ends, the edge (5*a*) of said first contact means being proximate the end which is remote from the portion of the first contact means (12) which contacts the ink ribbon.

3. A device as set forth in claim 1 wherein said first contact means (12) exhibit a distinct contact area (5*b*) which physically contacts the ink ribbon.

4. A device as set forth in claim 1 wherein the cassette (1) exhibits a structural web (14) adjacent and parallel to the ribbon path, said second contact means (6) being mounted on said web (14).

5. A device as set forth in claim 1 wherein said first contact means (12) is an acutely bent leaf spring having an end (5*b*) which engages the tape and an end (5) which defines said edge (5*a*) of said first contact means, said third and fourth contact means (7, 8) being studs which yieldingly engage said edges (5*a*, 6*a*).

6. A device as set forth in claim 1 wherein said printing unit (11) includes centering pins (22, 22*a*) extending therefrom and said cassette (1) includes slot openings (23) to receive said pins and permit said cassette to be placed in the operative mounted association with said printer unit.

* * * * *